US012680231B2

(12) United States Patent
Dang et al.

(10) Patent No.: US 12,680,231 B2
(45) Date of Patent: Jul. 14, 2026

(54) SOFTENER CONCENTRATE, SOFTENER EMULSION, METHOD FOR PRODUCING SOFTENER EMULSION AND ITS USE

(71) Applicant: KEMIRA OYJ, Helsinki (FI)

(72) Inventors: Zheng Dang, Atlanta, GA (US); Junhua Chen, Atlanta, GA (US); Clayton Campbell, Atlanta, GA (US); Yong Zou, Atlanta, GA (US); Yuping Luo, Atlanta, GA (US)

(73) Assignee: KEMIRA OYJ, Helsinki (FI)

( * ) Notice: Subject to any disclaimer, the term of this patent is extended or adjusted under 35 U.S.C. 154(b) by 310 days.

(21) Appl. No.: 18/269,826

(22) PCT Filed: Dec. 27, 2021

(86) PCT No.: PCT/FI2021/050913

§ 371 (c)(1),
(2) Date: Jun. 27, 2023

(87) PCT Pub. No.: WO2022/144502

PCT Pub. Date: Jul. 7, 2022

(65) Prior Publication Data

US 2024/0318383 A1 Sep. 26, 2024

Related U.S. Application Data

(60) Provisional application No. 63/131,328, filed on Dec. 29, 2020.

(30) Foreign Application Priority Data

Jan. 21, 2021 (FI) ..... 20215068

(51) Int. Cl.
*D21H 17/00* (2006.01)
*D21H 17/02* (2006.01)
(Continued)

(52) U.S. Cl.
CPC ..... *D21H 17/72* (2013.01); *D21H 17/02* (2013.01); *D21H 17/07* (2013.01); *D21H 17/60* (2013.01); *D21H 23/08* (2013.01)

(58) Field of Classification Search
CPC ..... D21H 17/72; D21H 17/02; D21H 17/07; D21H 17/60; D21H 23/08; D21H 17/10;
(Continued)

(56) References Cited

U.S. PATENT DOCUMENTS 4,787,995 A * 11/1988 Nichols ..... C10M 129/56 508/451
6,277,467 B1 8/2001 Dwiggins et al.
(Continued)

FOREIGN PATENT DOCUMENTS

CN 111135144 A 1/2020
EP 3719199 A1 10/2020
(Continued)

OTHER PUBLICATIONS paperonweb.com, Jan. 2, 2006 url: https://web.archive.org/web/20060312090517/http://www.paperonweb.com/A1021.htm (Year: 2006).*

(Continued)

*Primary Examiner* — Abbas Rashid
*Assistant Examiner* — Elisa H Vera
(74) *Attorney, Agent, or Firm* — Meunier Carlin & Curfman LLC

(57) ABSTRACT

The present invention provides a softener concentrate and a softener emulsion comprising imidazoline-based surfactant, lanolin-based softener, phospholipids and surfactant blend. The present invention further provides a process for producing a softener emulsion and controlling the viscosity of a softener emulsion. The present invention also provides a method for producing paper, tissue or paperboard, in which method a softener according to the present invention is used.

14 Claims, 7 Drawing Sheets

(51) Int. Cl.

| | |
|---|---|
| ***D21H 17/07*** | (2006.01) |
| ***D21H 17/60*** | (2006.01) |
| ***D21H 23/08*** | (2006.01) |

(58) Field of Classification Search
CPC ..... D21H 17/14; D21H 21/22; D21H 21/24; D21H 21/14
See application file for complete search history.

(56) References Cited

U.S. PATENT DOCUMENTS

| | | | | |
|---|---|---|---|---|
| 6,416,624 | B1 | 7/2002 | Nielsen et al. | |
| 2011/0217345 | A1* | 9/2011 | Huang | D21H 19/32 428/447 |
| 2020/0149223 | A1 | 5/2020 | Lu et al. | |

FOREIGN PATENT DOCUMENTS

| | | | |
|---|---|---|---|
| TW | 201005035 | A | 2/2010 |
| WO | 9731153 | A1 | 8/1997 |
| WO | 2017151084 | A1 | 9/2017 |
| WO | 2018136318 | A1 | 7/2018 |

OTHER PUBLICATIONS

International Search Report and Written Opinion in Application No. PCT/FI2021/050913, mailed Mar. 24, 2022, 9 pages.
Search Report in Finnish Application No. 20215068, dated Aug. 17, 2021, 2 pages.
Search Report in Chinese Application No. 2021800743568 and English translation thereof, mailed Jan. 22, 2025 (5 pages).

* cited by examiner

SOFTENER CONCENTRATE, SOFTENER EMULSION, METHOD FOR PRODUCING SOFTENER EMULSION AND ITS USE

CROSS REFERENCES

This is a U.S. national stage application of international patent application number PCT/FI2021/050913 filed on Dec. 27, 2021 claiming priority to US provisional application U.S. 63/131,328 filed on Dec. 29, 2020 and to Finnish national application FI20215068 filed on Jan. 21, 2021.

FIELD OF INVENTION

The present invention relates to a softener concentrate and a softener emulsion. The present invention further relates to a process for producing a softener emulsion and controlling the viscosity of a softener emulsion. The present invention also relates to a method for producing paper, tissue or paperboard, in which method a softener according to the present invention is used.

BACKGROUND

Softeners are typically used to impart bulk softness in e.g. tissue paper and textile products by reducing the number of inter-fiber hydrogen bonds and improving surface softness and smoothness through the presence of emollient chemicals on the tissue paper or textile surface. Conventionally, softener emulsions mainly consist of imidazoline-based surfactants that may impose a health hazard as well as an environmental risk. Hence, there is a need for tissue and textile products which can be more environmentally non-hazardous and simultaneously provide a satisfactory softness. The products should also meet the consumer expectations relating to sustainability and ecological friendliness.

Another disadvantage of conventional softener emulsions is high viscosity. The viscosity of a softener emulsion can increase rapidly to a range from 500 to 10,000 cPs in the emulsification process, which makes the emulsion difficult or even impossible to apply. In spray applications, especially in dry sheet spray application, it is desired to use a low-viscosity softener emulsion with a viscosity of lower than 500 cPs, preferably lower than 100 cPs. Dilution of a higher-viscosity emulsion with water to reduce the viscosity might not be a feasible option, because dilution may break the emulsion stability, resulting in clogging of the sprayer. Further, diluting the softener emulsion results in spraying a higher amount of water onto the dry sheet, causing destruction of sheet integrity in the paper product.

Another problem associated with high viscosity is that entrained air introduced during mixing or homogenization cannot be easily released. Entrained air in an emulsion can cause emulsion instability, promote microbial growth, and facilitate undesirable oxidation. Therefore, an effective way to reduce viscosity of this type of softener emulsion is required.

One possible explanation for the high viscosity of the softener emulsion is the bubble bridge phenomenon imparted by the entrained air. The surfactant molecules in the softener emulsion facilitate the formation of entrained air bubbles during agitation or homogenization and make bubbles a very stable structure, preventing coalescence to form larger bubbles which could rise and release to the environment. The entrained air bubbles could form bridges with the particles in the emulsion and this phenomenon leads to increased bonding between particles and in turn cause the increment of bulk viscosity.

SUMMARY OF THE INVENTION

An object of the present invention is to minimise or possibly even eliminate the disadvantages existing in the prior art.

A further object of the present invention is to provide an improved softener product yielding higher softness in paper, tissue or paperboard products.

A yet further object of the present invention is to provide an environmentally less hazardous bio-based softener product with a reduced health risk compared to imidazoline-based softener products existing in the prior art.

These objects are attained with the invention having the characteristics presented below in the characterising parts of the independent claims. Some preferable embodiments are disclosed in the dependent claims.

The features recited in the dependent claims and the embodiments in the description are mutually freely combinable unless otherwise explicitly stated.

The exemplary embodiments presented in this text and their advantages relate by applicable parts to all aspects of the invention, even though this is not always explicitly mentioned.

A typical softener concentrate for use in manufacture of a paper, tissue or paperboard according to the present invention comprises

- 5 to 10 wt-% an imidazoline-based surfactant with a carbon chain longer than 10 carbon atoms, of the total weight of the softener concentrate;
- lanolin-based softener;
- phospholipids; and
- a surfactant blend comprising polysorbate ester, sorbitan ester-based surfactants, polypropylene glycol, polyethylene glycol, and their esters, silicon-based softeners, or any combination thereof.

The inventors have surprisingly found that the imidazoline-content of softener products may be reduced by using the softener concentrate according to the present invention while still providing a similar performance than when using conventional softeners with higher imidazoline concentration. Therefore, the present invention has an advantage of minimizing the health hazard imposed by imidazoline-based surfactants and also provide an environmentally less hazardous bio-based softener product. A softener concentrate according to the present invention is well suited for an oil-in-water emulsifier with a hydrophilic-lipophilic balance (HLB) value of 8 to 9.

It has now been surprisingly found that lanolin-based softeners and phospholipids are well suitable for use in softener products. Lanolin-based softeners as well as phospholipids, such as lecithin, offer a bio-based alternative to the conventional imidazoline-based surfactants. Lanolin-based softeners and phospholipids are in most cases suitable for digestion, which makes them very safe materials for surfactant production.

DETAILED DESCRIPTION OF THE INVENTION

A typical softener emulsion according to the present invention comprises

- 20 to 50 wt-%, preferably 25 to 30 wt-% the softener concentrate comprising 5 to 10 wt-% an imidazoline-based surfactant with a carbon chain longer than 10 carbon atoms, of the total weight of the softener concentrate;

lanolin-based softener;

phospholipids;

a surfactant blend comprising polysorbate ester, sorbitan ester-based surfactants, polypropylene glycol, polyethylene glycol, and their esters, silicon-based softeners, or any combination thereof, and 50 to 80 wt-%, preferably 70 to 75 wt-% water, of the total weight of the softener emulsion.

The inventors have surprisingly found that a softener emulsion according to the present invention yields an improved softness in paper, tissue, paperboard compared to a conventional softener.

A typical process for producing a softener emulsion according to the present invention comprises providing a softener concentrate comprising 5 to 10 wt-% an imidazoline-based surfactant with a carbon chain longer than 10 carbon atoms, of the total weight of the softener concentrate;

lanolin-based softener;

phospholipids;

a surfactant blend comprising polysorbate ester, sorbitan ester-based surfactants, polypropylene glycol, polyethylene glycol, and their esters, silicon-based softeners, or any combination thereof, emulsifying the softener concentrate with water, thus forming a softener emulsion comprising 20 to 50 wt-% softener concentrate of the total weight of the softener emulsion, treating the softener emulsion with a high shear homogenizer and/or ultrasonic energy, thus reducing viscosity of the softener emulsion.

The present invention has an advantage of providing a method for reducing the viscosity of softener emulsions effectively and cost-efficiently. According to the present invention, the viscosity of a softener emulsion may be reduced either directly after the emulsifying step and/or after transportation to the production site utilizing the softener emulsion.

The inventors have surprisingly found that using a high shear homogenizer as a post treatment for the softener emulsion can break the bubble bridges and release the entrained air, resulting in a reduction of bulk viscosity. Homogenization provides a combined effect of mainly three phenomena, including shear, turbulence, and cavitation.

The inventors have surprisingly found that ultrasonic treatment may be used for reducing the viscosity of a softener emulsion according to the present invention. It generates high shear forces which can break inter and intramolecular bonds, resulting in the breakdown of aggregates in the softener emulsion, and in turn reduce the viscosity of the emulsion. In addition, ultrasonic treatment can be used for degassing liquids. Ultrasonic cavitation can generate shear force which could break aggregates, and in turn reduce the particle size and the viscosity. In addition, ultrasonic energy could create vacuum voids in the emulsion, and therefore the micro air bubbles migrate into the voids, resulting in the increase of bubble size and the release of entrained air to the environment. This could also lead to the break of bubble bridges and in turn the reduction of viscosity.

The high-shear homogenization and the ultrasonic treatment can be used as post treatments on emulsions individually or jointly. In addition, these two methods can be operated directly on production site with a sprayer system for spray application of softener emulsion. Viscosity of the softener emulsion is prone to increase during transportation, even if the emulsion had been treated with the high-shear homogenizer and/or ultrasound shortly after preparation. The present invention has an advantage of providing a softener emulsion with freshly reduced viscosity directly on the production site utilizing it.

The present invention can also be used as a treatment to reduce the viscosity of a softener emulsion prior to filtration in order to remove any undissolved particles from the emulsion.

The present invention provides a process for making paper, wherein a softener emulsion is added to fiber slurry having a consistency of 0.05 wt-% to 8 wt-% at the wet end of paper, paperboard or tissue machine, and/or a softener emulsion is applied on the wet fiber web having a moisture level of 30 to 90%, as weight percentage of water in the wet fiber web, and/or a softener emulsion is applied on the dry sheet or converted roll having a moisture level of less than 12%, as weight percentage of water in the dry sheet or converted roll.

The present invention further provides a use of a softener emulsion as a debonder to produce fluff pulp, as a releasing agent in papermaking processes, as a bulking agent for tissue, paper, and paperboard products, or as a fluting agent for linerboard applications. A softener emulsion of the present invention may also be used to increase the bulk and softness of textile products.

Figure 1:
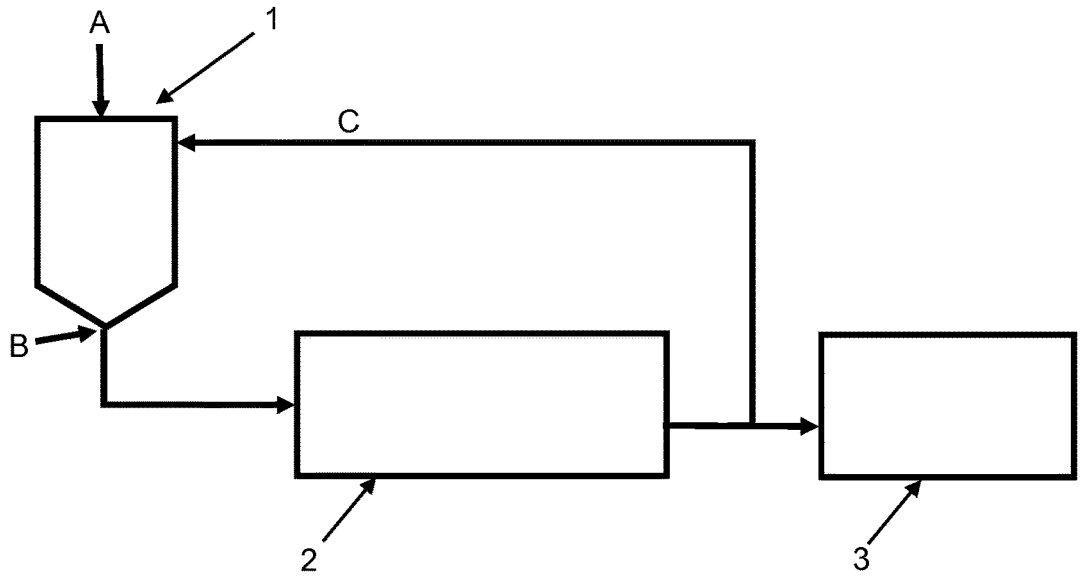
FIG. 1A schematic view of a process of on-site viscosity reduction of softener emulsion for dry sheet spray application, FIG. 2 Dry tensile measurement results for dry sheet spray application in Example 2, FIG. 3 Softness HF measurement results for dry sheet spray application in Example 2, FIG. 4 Softness TS7 measurement results for dry sheet spray application in Example 2, FIG. 5 Softness TS750 measurement results for dry sheet spray application in Example 2, FIG. 6 Softness D value results for dry sheet spray application in Example 2, FIG. 7 Dry tensile measurement results for wet web spray application in Example 3, FIG. 8 Bulk measurement results for wet web spray application in Example 3, FIG. 9 Softness TS7 measurement results for wet web spray application in Example 3, FIG. 10 Softness D value results for wet web spray application in Example 3, FIG. 11 Dry tensile measurement results for wet end application in Example 4, FIG. 12 Bulk measurement results for wet end application in Example 4, FIG. 13 Softness TS7 measurement results for wet end application in Example 4, FIG. 14 Softness TS750 measurement results for wet end application in Example 4, FIG. 15 Softness D value results for wet end application in Example 4, and FIG. 16 Viscosity variation of softener emulsion during the ultrasonic treatment in Example 6.

Regarding a first aspect of the present invention, a softener concentrate is disclosed.

In an embodiment of the present invention, the softener concentrate comprises 5 to 10 wt-% imidazoline-based surfactant with a carbon chain longer than 10 carbon atoms, 5 to 10 wt-% lanolin-based softener, 5 to 20 wt-% phospholipids, and 60 to 85 wt-% surfactant blend, of the total weight of the softener concentrate. According to the present invention, a surfactant blend comprises polysorbate ester, sorbitan ester-based surfactants, polypropylene glycol, polyethylene glycol, and their esters, silicon-based softeners, or any combination thereof. In a preferred embodiment of the present invention, a surfactant blend comprises sorbitan ester-based softeners and/or polysorbate ester. In an embodiment of the present invention a surfactant blend comprises sorbitan ester-based softeners and polysorbate ester in a weight ratio of 2:1.

In a preferred embodiment, the softener concentrate comprises 5 to 8 wt-% imidazoline-based surfactant, 5 to 8 wt-% lanolin-based softener, 7 to 15 wt-% phospholipids, and 69 to 83 wt-% surfactant blend, of the total weight of the softener concentrate. In a more preferred embodiment, the softener concentrate comprises 5 wt-% imidazoline-based surfactant, 5 wt-% lanolin-based softener, 10 wt-% phospholipids, and 80 wt-% surfactant blend, of the total weight of the softener concentrate Regarding a second aspect of the present invention, a softener emulsion is provided. A softener emulsion according to the present invention comprises 20 to 50 wt-%, preferably 25 to 30 wt-% the softener concentrate of the present invention and 50 to 80 wt-%, preferably 70 to 75 wt-% water, of the total weight of the softener emulsion. A softener emulsion is produced by emulsifying a softener concentrate according to the present invention with water. The softener concentrate according to the present invention is typically prepared using a regular mixer or a homogenizer. The emulsion is prepared by adding water. After the emulsification process is complete, the mixing is stopped and the softener emulsion is transferred into a storage and/or transport container.

In an embodiment according to the present invention, the imidazoline-based surfactant with a carbon chain longer than 10 carbon atoms comprises a carbon chain of 16 to 18 carbon atoms. In an embodiment according to the present invention, the carbon chain of 16 to 18 carbon atoms is a saturated or unsaturated fatty acid. In a preferred embodiment, the fatty acid is selected from oleic acid, palmitic acid, or a combination thereof. According to an embodiment of the present invention, the imidazoline-based surfactant is synthesized by a reaction of the fatty acid with diethylenetriamine (DETA), followed by cyclization, and a quaternization with diethyl sulfate. According to an embodiment of the present invention, the acid-to-DETA ratio is preferably in the range of 1:1 to 2:1. The cyclization reaction is preferably completed to a degree of 80 to 95%, and the quaternization reaction is preferably completed to a degree of 90 to 95%.

According to the present invention, the softener concentrate and the softener emulsion comprise a lanolin-based softener. In an embodiment, the lanolin-based softener comprises USP grade lanolin, lanolin wax, lanolin oil, or any combination thereof. Lanolin is a wax secreted by the sebaceous glands of wool-bearing animals. Lanolin comprises long chain waxy esters (approximately 97% by weight) with the remainder being lanolin alcohols, lanolin acids and lanolin hydrocarbons. Conventionally, lanolin is used for personal care, such as cosmetics, as well as health care, such as topical liniments. The inventors have now surprisingly found that lanolin is suitable for a softener concentrate and softener emulsion according to the present invention.

In an embodiment, the softener concentrate and the softener emulsion comprise phospholipids. In a preferred embodiment according to the present invention, phospholipids comprise lecithin. Lecithins are a group of fatty substances occurring in animal and plant tissues. Lecithins are amphiphilic and are known for being used for smoothing food textures, emulsifying, homogenizing liquid mixtures, and repelling sticking materials. In an embodiment according to the present invention, lecithin originates from soybeans, sunflower oil, rapeseeds and/or cottonseeds. Soybeans and sunflower oil are among the major sources of lecithin. Other relevant sources of lecithin comprise rapeseed. According to an embodiment of the present invention, the inventors have found that soy lecithin and/or sunflower lecithin are well suitable for a softener concentrate and a softener emulsion. Hence, in a preferred embodiment of the present invention lecithin comprises soy lecithin and/or sunflower lecithin.

In an embodiment according to the present invention, the softener emulsion further comprises an electrolyte. In an embodiment of the present invention an electrolyte may be selected from soluble salts, acids, bases, polyelectrolytes, or any combination thereof. In an embodiment according to the present invention, the electrolyte comprises NaCl, $CaCl_2$), $MgCl_2$, $NaNO_3$, $Na_2SO_4$, KCl, phosphate anions, or any combination thereof. The electrolyte has an advantage of contributing to the viscosity reduction in the softener emulsion.

In an embodiment according to the present invention, the softener emulsion comprises the electrolyte in an amount of 0.01 to 1.0 wt-%, preferably 0.01 to 0.5 wt-%, more preferably 0.01 to 0.3 wt % or 0.01 to 0.25 wt % and even more preferably 0.01 to 0.05 wt-%, of the weight of the softener emulsion. The electrolyte can reduce the stability of the softener emulsion if the electrolyte concentration is too high. Therefore, it is preferable for the softener composition to have a low concentration of electrolyte. Ideally the electrolyte concentration may be high enough to provide a low desired viscosity while the stability of the softener emulsion is maintained. According to an embodiment of the present invention, the electrolyte is added in an amount that reduces the viscosity of the softener emulsion to lower than 500 cPs, preferably lower than 200 cPs, more preferably lower than 100 cPs, even more preferably lower than 50 cPs, when measured with a Brookfield Viscometer, DV2T, with #63 spindle and spindle rotation speed at 30 rpm at ambient temperature. A softener emulsion with a low viscosity has the advantage of simple and straightforward application by spraying, with a reduced or eliminated risk of clogging the spraying system.

Regarding a third aspect of the invention, a process for producing a softener emulsion is provided. The production process steps may be carried out at a single location, or the softener emulsion may be transported to e.g. a paper manufacturing site prior to the high shear homogenizer and/or ultrasound treatment step.

In an embodiment according to the present invention, the process for producing a softener emulsion comprises adding an electrolyte. In an embodiment of the present invention an electrolyte is selected from soluble salts, acids, bases, polyelectrolytes, or any combination thereof. In a preferred embodiment, the electrolyte comprises NaCl, $CaCl_2$), $MgCl_2$, $NaNO_3$, $Na_2SO_4$, KCl, phosphate anions, or any combination thereof. The inventors have surprisingly found that adding an electrolyte to a softener emulsion may advantageously contribute to the reduction of viscosity of a softener emulsion.

In an embodiment according to the present invention, the electrolyte is added in an amount of 0.01 to 1.0 wt-%, preferably 0.01 to 0.5 wt-%, more preferably 0.01 to 0.3 wt % or 0.01 to 0.25 wt % and even more preferably 0.01 to 0.05 wt-%, of the weight of the softener emulsion. In an embodiment according to the present invention, the electrolyte is added before, during and/or after the emulsifying step, preferably after the emulsifying step. In another embodiment according to the present invention, the electrolyte is added before, during and/or after the high shear homogenizer and/or ultrasound treatment.

In an embodiment of the present invention, the process can also be used as a treatment to reduce the viscosity of an emulsion prior to filtration in order to remove any undissolved particles.

In an embodiment of the present invention, the process can also be used as a treatment to reduce the viscosity of emulsion in order to improve the emulsion stability.

The high shear homogenizer treatment and/or the ultrasonic treatment may be operated on a production site with a sprayer system for spray application of the softener emulsion. Coupling the addition of the electrolyte with the high shear homogenizer and/or ultrasound treatment has the advantage of simple treatment of the softener emulsion directly on-site, achieving a freshly-treated softener emulsion with low viscosity ready for spray application of neat product.

In an embodiment according to the present invention, the softener emulsion is treated with ultrasonic energy for a period of 1 to 60 min, preferably 10 to 30 min. Treating the softener emulsion for the preferred time reduces the viscosity of the softener emulsion to the preferred level.

According to the present invention, the softener emulsion may be added to fiber slurry at the wet end of the paper machine, and/or a softener emulsion may be applied on the wet fiber web or at the dry sheet or converted roll.

Emulsion may be applied on the wet fiber web and/or on the dry sheet by spraying or any other suitable method.

In an embodiment, the softener emulsion may be added to fiber slurry at wet end of paper, tissue or board machine. The fiber slurry may comprise bleached and/or unbleached fibers comprising virgin fibres and/or recycled fibers from fiber sources selected from hardwood (HW), such as eucalyptus, aspen and birch, softwood (SW), such as spruce, pine, fir, larch and/or hemlock, non-wood fibres such as bamboo, cotton, hemp and/or linen, or any combination thereof.

According to an embodiment of the present invention, the emulsion may be diluted for wet end application. A diluted softener emulsion may comprise 0.01 to 10 wt-% softener concentrate, and 90 to 99.9 wt-% water, preferably the diluted softener emulsion comprises 0.01 to 5 wt-% softener concentrate and 95 to 99.9 wt-% water, of the total weight of the softener emulsion. In an especially preferred embodiment, the diluted softener emulsion comprises 1 wt-% softener concentrate and 99% water, of the total weight of the diluted softener emulsion. According to an embodiment of the present invention, dosage of the softener emulsion may be from 1.5 to 20 kg/t (3 to 40 lb/ton) of dry pulp, preferably from 1.5 to 6 kg/t (3 to 12 lb/ton) of dry pulp, as weight of the softener concentrate.

In an embodiment of the present invention, the softener emulsion may be applied at the wet fiber web. The softener emulsion is typically applied by spraying. The web may have a moisture content of 30 to 90%, as weight percentage of water in the wet fiber web. According to an embodiment of the present invention, dosage of the softener emulsion may be from 1.5 to 20 kg/t (3 to 40 lb/ton) of dry pulp, preferably from 1.5 to 6 kg/t (3 to 12 lb/ton) of dry pulp, as weight of the softener concentrate.

In an embodiment of the present invention, the softener emulsion may be applied at the dry sheet or converted roll. The dry sheet or converted roll may have a moisture content of less than 12%, as weight percentage of water in the dry sheet or converted roll. According to an embodiment of the present invention, dosage of the softener emulsion may be from 1.5 to 20 kg/t (3 to 40 lb/ton) of dry pulp, preferably from 1.5 to 6 kg/t (3 to 12 lb/ton) of dry pulp, as weight of the softener concentrate.

In the present disclosure, t refers to a tonne (1000 kg), whereas ton refers to a short ton (2000 lb).

Spraying softeners onto dry sheet requires a low viscosity fluid to achieve a uniform spray pattern. For instance, one of the industrial standard equipment, i.e., WEKO fluid application system, prefers the viscosity of the softener emulsion even lower than 100 cPs. Although the softener emulsion can be reduced in viscosity right after manufacturing, the viscosity might increase during transportation or storage at an elevated temperature or a cold temperature, because the particles are prone to aggregation. Therefore, an on-site process to reduce the emulsion viscosity and maintain the low emulsion viscosity is desired.

FIG. 1 depicts a novel process which uses either a high shear homogenizer equipment or an ultrasound unit with or without adding electrolytes to achieve the low viscosity. The softener emulsion may be stored at a storage tank 1.

The softener emulsion is pumped through a high shear equipment or an ultrasonic equipment in unit 2. The high shear homogenizer can be any high-speed machine offering homogenization, emulsification, or disintegration, such as a homogenizer, a colloid mill, or an emulsifier. The desired amount of electrolytes can be added (A) on the top of the storage tank 1 or (B) the inlet of the discharge pump of the storage tank 1. The softener emulsion can be recirculated (C) to the storage tank 1 until the viscosity of emulsion reaches the target range. Subsequently, the emulsion may be supplied to dry sheet spray system 3.

The present invention further provides a use of the softener emulsion to increase the bulk and softness of textile products. Comprising a cationic surfactant, the softener emulsion according to the present invention adheres well to natural fibers such as wool and cotton. The softener emulsion according to the present invention provides a bio-based alternative to synthetic textile softeners.

The present invention further provides a use of the softener emulsion as a debonding agent to produce fluff pulp. Fluff pulp is used in e.g. infant diapers, feminine hygiene products and sanitary napkins. A fluff pulp product is typically converted from a sheeted form to individual fibers. The pulp is typically treated with a debonding agent at the wet end which can interfere with the formation of hydrogen bonding between fibers during drying. The softener emulsion according to the present invention is well suitable as a debonding agent, providing defibering of the pulp through control of inter-fiber hydrogen bonds.

The present invention further provides a use of the softener emulsion as a releasing agent in the manufacture of paper and paperboard. The softener emulsion according to the present invention may provide a bio-based alternative to conventional releasing agents having a good releasing performance.

The present invention further provides a use of the softener emulsion as a bulking agent for tissue, paper, and paperboard products. A bulking agent increases the pore volume of a tissue, paper or paperboard product, resulting in an increase of sheet thickness. The softener emulsion according to the present invention may provide a bio-based alternative to conventional bulking agents.

The present invention further provides a use of the softener emulsion as a fluting agent for linerboard applications.

EXPERIMENTS

Experiment 1. Handsheet Preparation for Wet End Application of Softener

Two different fiber blends were used in this evaluation, i.e., 50:50 and 70:30 eucalyptus to softwood ratio. The eucalyptus pulp was re-slushed with Valley beater without refining. Lab softwood was refined to around 500 CSF (Canadian Standard Freeness) and blended with eucalyptus at the target ratio. The fiber blends were diluted with synthetic water treated with 35 ppm of $Ca^{2+}$ and 150 ppm of $SO_4^{2-}$ separately to about 0.45%. The pH of the furnish was approximately 7.0.

Chemicals were mixed with fiber slurry for 45 seconds before making handsheet. The softener emulsion was diluted to 1 wt-% in softener concentrate concentration of the total weight of the diluted softener emulsion, and then dosed to the thin furnish at 3 and 6 kg/t of dry pulp (6 and 12 lb/ton of dry pulp), as weight of softener concentrate. A commercial coagulant (FennoFix 501, Kemira Oyj) was used in some examples.

Handsheets (target to about 35 g/m$^2$) were prepared according to the standard handsheet protocol by Dynamic Sheet Former (DSF) from Techpap. Sheets were drum-dried (set at 115° C. for 60-second total drying time) with a backing blotter paper without wet press.

Experiment 2. Handsheet Preparation for Wet Web Spray of Softener Emulsion

The thin furnish was prepared similarly than in Experiment 1. Two blank conditions were included in the wet web study. No chemicals were added in wet end. Handsheets (target to about 35 g/m$^2$) were prepared according to the standard handsheet protocol by Dynamic Sheet Former (DSF) from Techpap. After making the handsheet, the master sheet was cut into 3 pieces with a width of 23 cm (9 inch). Each single sheet was sprayed using 1550 AutoJet Modelar Spray System with Phoenix I single axis Servo controller. The dosages of softener were 3 and 6 kg/t of dry pulp (6 and 12 lb/ton of dry pulp). The sheet was then sandwiched by two blotter papers and drum-dried (set at 115° C. for 60-second total drying time) without wet press.

Experiment 3. Dry Sheet Spray of Softener Emulsion

The sheet used for dry sheet spray was a commercial bath tissue base sheet obtained from a tissue paper mill. The basis weight of the base sheet was approximately 20 g/m$^2$. The spraying system is 1550 AutoJet Modular Spray System with Phoenix I single axis Servo controller. The 30% softener emulsion was used for this study. Add-on rate was estimated by the sheet weight difference pre- and post-spray then divided by the sheet weight. After spraying, the sheet was dried using a heat press set at 121° C. (250° F.) for 60 s without press.

Experiment 4. Paper Sample Handling and Preparation

The handsheet samples and the tissue base sheets were conditioned at 23° C. and 50% relative humidity for at least 24 hours, per TAPPI 402, prior to testing. Special care was taken to avoid impacting the sheet structure. The areas closed to the edges of the sheet were avoided during testing. Wrinkled area from the commercial base sheet were avoided if possible.

Experiment 5. Caliper

Sheet caliper was measured using a Thwing Albert ProGage thickness tester, using 35.7 mm diameter foot with 2.0 kPa of pressure. This procedure references TAPPI Test Method T580 pm-12 "Thickness of towel, tissue, napkin and facial products". The sample was measured with the tissue stacked in 8 plies for commercial base sheet and single ply was used for handsheet sample. Six replicates and eight replicates per condition for handsheet and commercial base sheet respectively were taken, and the average value being reported. Bulk value is calculated by using average caliper divided by average grammage.

Experiment 6. Grammage

The handsheet sample was cut with a 112.8 mm diameter circular punch cutter as single ply and then weighed on an analytical balance. For the commercial base sheet, eight plies were cut using the cutter. The grammage was calculated based on area and is reported in g/m$^2$ per sheet.

Experiment 7. Tensile Strength, Dry

Tensile strength is measured by applying a constant rate-of-elongation to a sample and recording three tensile breaking properties of paper and paper board: the force per unit width required to break a specimen (tensile strength), the percentage elongation at break (stretch) and the energy absorbed per unit area of the specimen before breaking (tensile energy absorption). This method is applicable to all types of paper, but not to corrugated board. This procedure references TAPPI Test Method T494. A minimum of twelve measurements were taken per condition for handsheet sample and 16 measurements for commercial base sheet. The testing gap was set for 5 cm (2 inches). Handsheet sample were tested with single ply and commercial samples were tested with four plies. A Thwing-Albert QC 3A tensile tester with was used.

Experiment 8. Tissue Softness Analyzer (TSA)

Tissue softness was analyzed using the Emtec TSA Tissue Softness Analyzer. The TSA measures softness indicated by HF (hand feel), the TS7 value (correlates to real softness), TS750 (correlating to felt smoothness) and D value (correlates to stiffness). Hand feel (HF) is a combination parameter and has no units attached to the data value. Because the handsheet samples have no creping, no HF results was reported for lab handsheets. TS7 and TS750 are the peak heights (in dB V2 rms) recorded at 7000 and 750 Hz, respectively. The D value is the distance that the tissue is displaced by the impeller during the testing as the impeller presses against the sample, and is expressed in mm/N.

The TSA functions by clamping a tissue sample in the sample ring and measuring acoustic values as the surface of the tissue is brushed with a rotating wheel. The handsheet samples were run using the "research" algorithm, with the dryer side analyzed. No HF results were reported. Commercial base sheet samples used TPII algorithm. Table 1 below explains the four parameters and how to interpret the data.

TABLE 1

TSA Parameter and Data Interpretation

| Parameter | Correlation | How to Interpret |
|---|---|---|
| HF | Combination parameter for hand feel | Higher = better |
| TS7 | Real softness (from fibers) | Lower = softer |
| TS750 | Felt smoothness/roughness | Higher peak = higher roughness |
| D | Stiffness | Lower = stiffer |

Experiment 9. Bulk Viscosity of Emulsion

Viscosity is the resistance of a fluid to being deformed by shear or extensional stress. Bulk viscosity (BV) is a measurement of fluid as-is. A Brookfield Viscometer, DV2T, with #63 spindle and spindle rotation speed at 30 rpm is used for this study. A rotation speed of 20 rpm is used if the viscosity is higher than 4000 cPs. All viscosities were measured at ambient temperature.

Experiment 10. Particle Size Analysis

Emulsion sample is analyzed for particle size with a Horiba Laser Scattering Particle Size Distribution Analyzer, model LA-300. The sample is diluted using deionized water. The RR index is 1.1-0.00i. The median particle sizes, the mean particle sizes, and standard deviations of the distributions are reported in micrometers (μm).

Experiment 11. Viscosity Reduction by Hand Homogenizer

A hand homogenizer is used to treat emulsion. A certain amount of emulsion (e.g., 300 ml) is added into the cup of the hand homogenizer and then the emulsion is pressed through a small orifice.

Experiment 12. Viscosity Reduction by Ultrasonic Cleaning Bath

A conventional ultrasonic cleaning bath (Aquasonic Model 250T, 50/60 Hz Amps: 4) is used to treat the emulsion. Typically, 400 ml emulsion is filled in a glass jar and then put in the ultrasonic cleaning bath. The ultrasonic cleaning bath is turned on and treats the emulsion over a certain period until the emulsion viscosity reaches the target value, i.e., approximately 100 cPs.

Experiment 13. ORP Measurement of Emulsion

Oxidation-reduction potential (ORP) measurement indicates how oxidizing or reducing a liquid is. In this study, an Oakton ORP tester is used for the ORP measurement of the emulsion. The probe is placed into the emulsion and the ORP value is taken until the reading is stable.

EXAMPLES

A commercial softener product FennoSoft 868NV, an imidazoline-based softener from Kemira Oyj, was evaluated as the control in some of the examples shown below.

Example 1: Preparation of the Softener Emulsion

The softener concentrate was prepared prior to emulsification. Table 2 presents the composition of this formulation.

TABLE 2

The softener composition prior to emulsification.

| | Lanolin, wt-% | Soy Lecithin, wt-% | Imidazoline, wt-% | Surfactant Blend (sorbitan:polysorbate ester 2:1), wt-% |
|---|---|---|---|---|
| Softener concentrate | 5.0 | 10.0 | 5.0 | 80.0 |

A typical lab procedure of the preparation of a 350.0 g softener emulsion with 30% softener concentrate content according to the present invention is shown below.

I. Add 56.00 g sorbitan monooleate into a 500 ml stainless steel beaker.
II. Add 28.00 g polysorbate-20 into the beaker.
III. Add 10.50 g lecithin into the beaker.
IV. Add 5.25 g imidazoline into the beaker.
V. Add 5.25 g USP lanolin into the beaker.
VI. Place the beaker on the hot plate with temperature set at 100° C.
VII. Manually mix the blend until the lanolin melts and the blend is homogeneous. The temperature should not be below 40° C.
VIII. Place the beaker on the platform for homogenizer IKA T50.
IX. Start the homogenizer at low speed (i.e., 1000 rpm).
X. Add the 245.00 g warm tap water (~35° C.) into the beaker.
XI. Increase the speed to 2600 rpm and mix for 1 minute.
XII. Stop the homogenizer and transfer the emulsion to a jar for storage.

The composition of final emulsion according to the present invention with 30% solids content is shown below:

1.5 wt-% lanolin (USP)
3.0 wt-% non-GMO soy lecithin
1.5 wt-% imidazoline
16.0 wt-% sorbitan monooleate
8.0 wt-% polysorbate-20 (Polyethylene glycol sorbitan monolaurate)
70.0 wt-% water The imidazoline is produced by the reaction of a fatty acid with diethylenetriamine, and then cyclized, and finally quaternized by diethyl sulfate. The fatty acid is preferred to be oleic acid or palmitic. The oleic acid to DETA ratio is preferred in the range of 1 to 2. The cyclization reaction is preferably completed to a degree of 80 to 95%, and the quaternization reaction is preferably completed to a degree of 90 to 95%.

Example 2: Dry Sheet Spray

Figure 2:
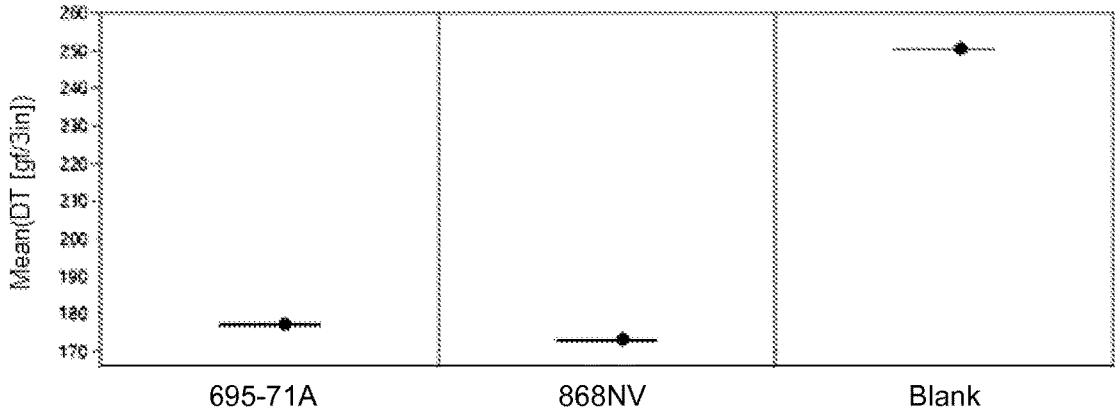
Figure 3:
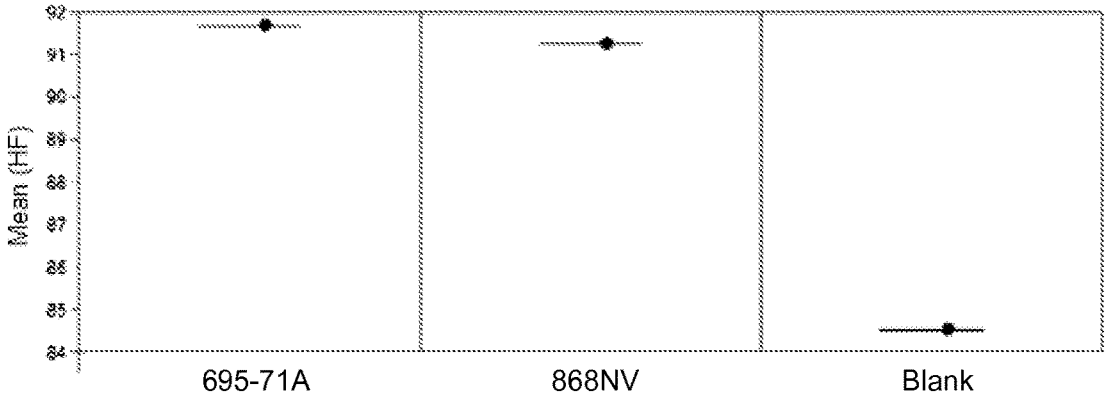
Figure 4:
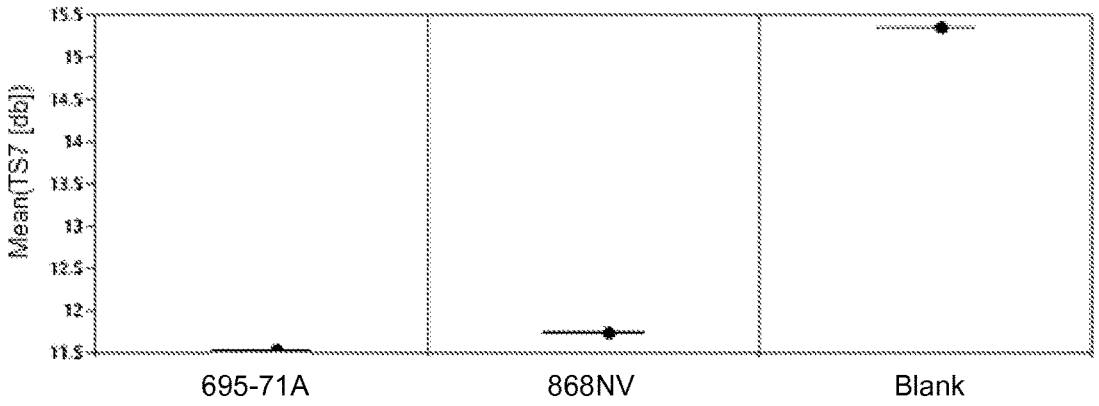
Figure 5:
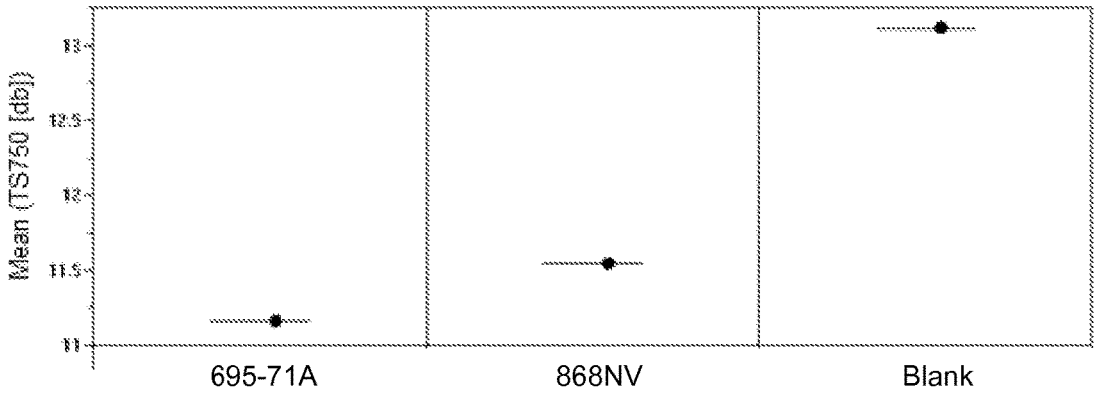
Figure 6:
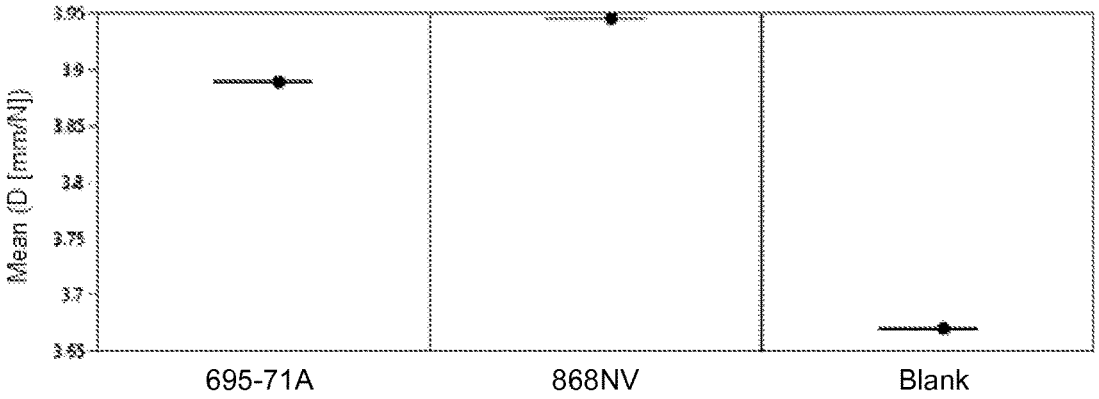

The results of dry sheet spray are presented in FIGS. 2 to 6. 868NV refers to 20% solids emulsion of the commercial control FennoSoft 868NV. 695-71A is a softener emulsion according to the present invention with 30 wt-% softener concentrate content. In FIG. 2, both emulsions decreased dry tensile (DT) by almost 30%. HF values shown in FIG. 3 were increased by 8% by these two emulsions. Both emulsions reduced TS7 (FIG. 4) and TS 750 (FIG. 5). D value was increased by dry sheet spray (FIG. 6). No significant differences of TSA testing results were observed between 695-71A and 868NV.

TABLE 3

Softener composition and dosage for Example 2.

| Softener | Lanolin, wt-% | Lecithin. wt-% | Imidazoline wt-% | Surfactant blend | Dosage, kg/t (lb/ton) |
|---|---|---|---|---|---|
| 695-71A | 5 | 10 | 5 | SMO-K/PSML-20LC 2:1 | 9 (18) |
| 868NV | 0 | 0 | 7 | 400DO | 5.6 (11.1) |
| Blank - Air | 0 | 0 | 0 | NA | 0 |

TABLE 4

Softness measurement values for Example 2.

| Softener | HF | TS7, dB | TS 750, dB | D, mm/N | DT, gf/3 in |
|---|---|---|---|---|---|
| 695-71A | 91.7 | 11.520 | 11.157 | 3.89 | 177 |
| 868NV | 91.3 | 11.731 | 11.540 | 3.94 | 173 |
| Blank - Air | 84.5 | 15.343 | 13.113 | 3.67 | 250 |

Example 3: Wet Web Spray

Figure 7:
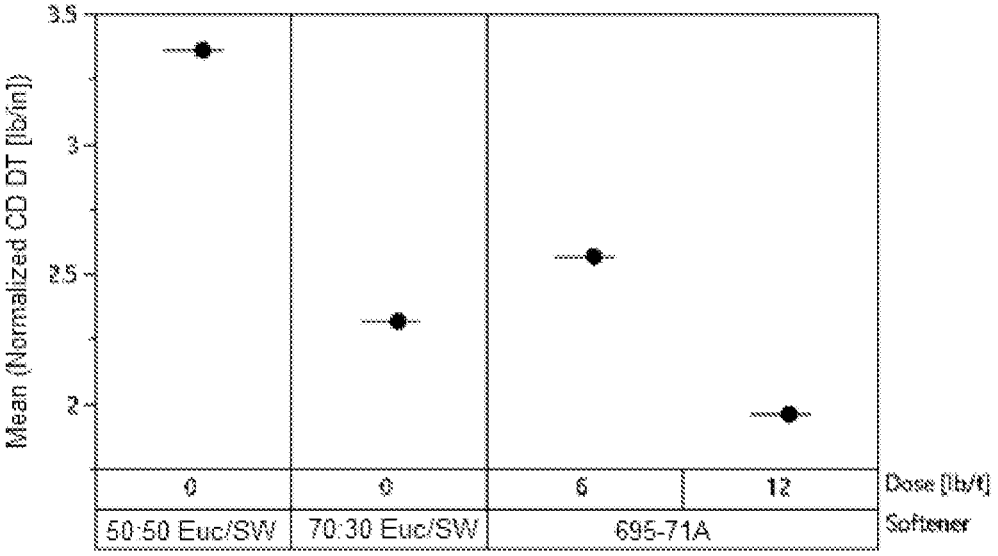
Figure 8:
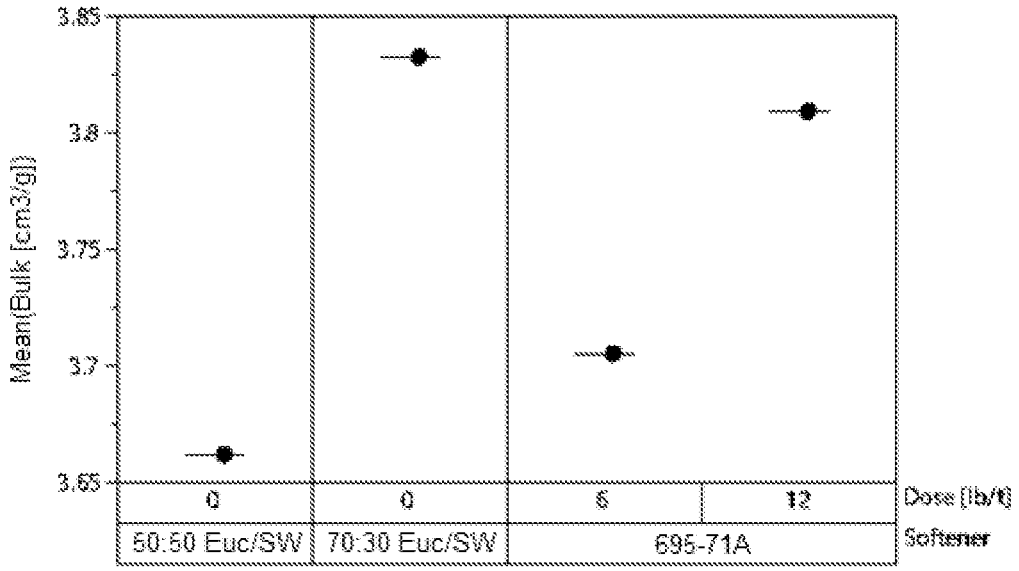
Figure 9:
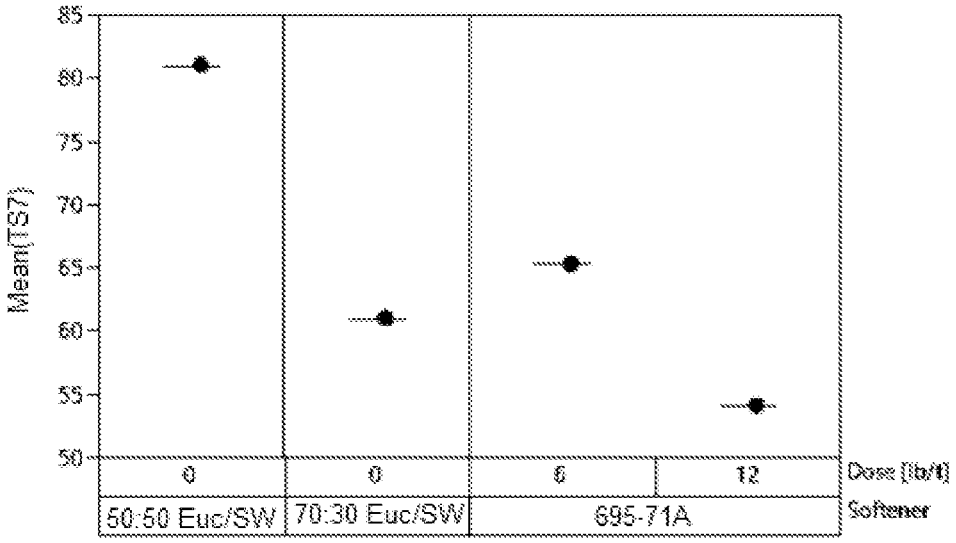
Figure 10:
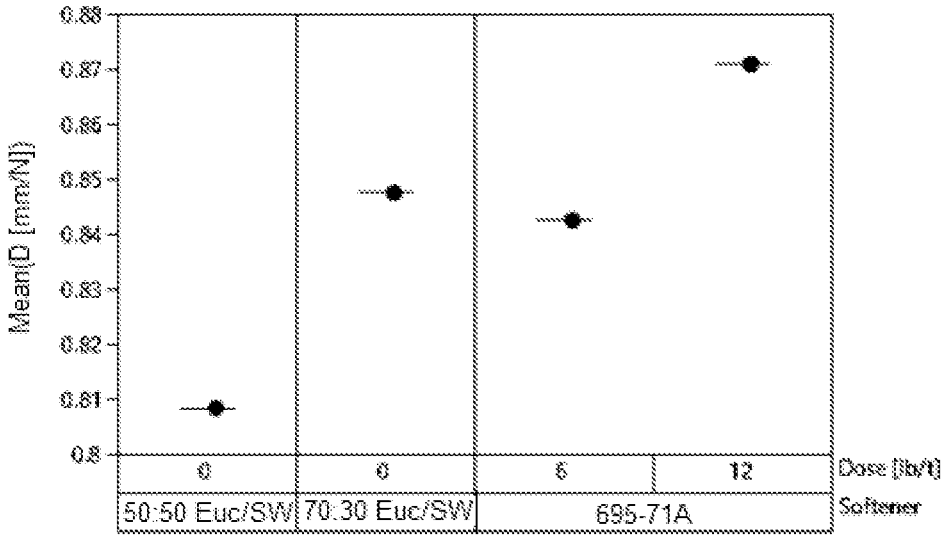

There are two blank conditions including 50:50 eucalyptus:softwood (SW) and 70:30 eucalyptus:SW in the wet web study. Due to the higher eucalyptus content, 70:30 eucalyptus gives better softness than 50:50 eucalyptus. The wet web spray of softener tested was applied only on 50:50 eucalyptus to softwood blend. The purpose to use 70:30 eucalyptus:SW as target is to 15 evaluate if softener treatment is able to provide 20% fiber substitution of eucalyptus. FIG. 7 displays the dry tensile results. A dosage response of softener to dry tensile can be observed for 695-71A, a softener emulsion according to the present invention. In addition, 695-71A gave significant higher bulk than 50:50 eucalyptus:SW blank shown in FIG. 8. TSA results are shown in FIGS. 9 and 10. 695-71A reduced TS7 and increased D value. At a dosage of 6 kg/t of dry pulp (12 lb/ton of dry pulp), as weight of the softener concentrate, 695-71A yielded slightly better softness results than 70:30 eucalyptus:SW blend.

TABLE 5

Dosage, dry tensile, bulk, and softness values for Example 3.

| Softener | Dosage, kg/t (lb/ton) | Normalized CD DT, kN/m (lb/in) | Bulk. $cm^3/g$ | TS7, dB | TS 750, dB | D, mm/N |
|---|---|---|---|---|---|---|
| 50:50 Euc/SW | 0 | 0.588 (3.36) | 3.66 | 80.960 | 52.914 | 0.81 |
| 70:30 Euc/SW | 0 | 0.406 (2.32) | 3.83 | 60.978 | 43.790 | 0.85 |
| 695-71A | 3 (6) | 0.450 (2.57) | 3.71 | 65.293 | 45.707 | 0.84 |
| 695-71A | 6 (12) | 0.343 (1.96) | 3.81 | 54.087 | 43.459 | 0.87 |

Example 4: Wet End Application

The strength and softness results in terms of wet end application of softener are shown in FIG. 11 to FIG. 15. In these figures, the blank 1 is the 50:50 eucalyptus to softwood fiber blend, and blank 2 is the 70:30 eucalyptus to softwood fiber blend. Both blanks did not use any chemical additions. All chemical treatments are used only on 50:50 eucalyptus to softwood blend. The softness target is blank 2. Blank 2 gives better softness than blank 1 due to higher eucalyptus content. The purpose to use blank 2 as target is to evaluate if softener treatment is able to provide 20% fiber substitution of eucalyptus.

Figure 11:
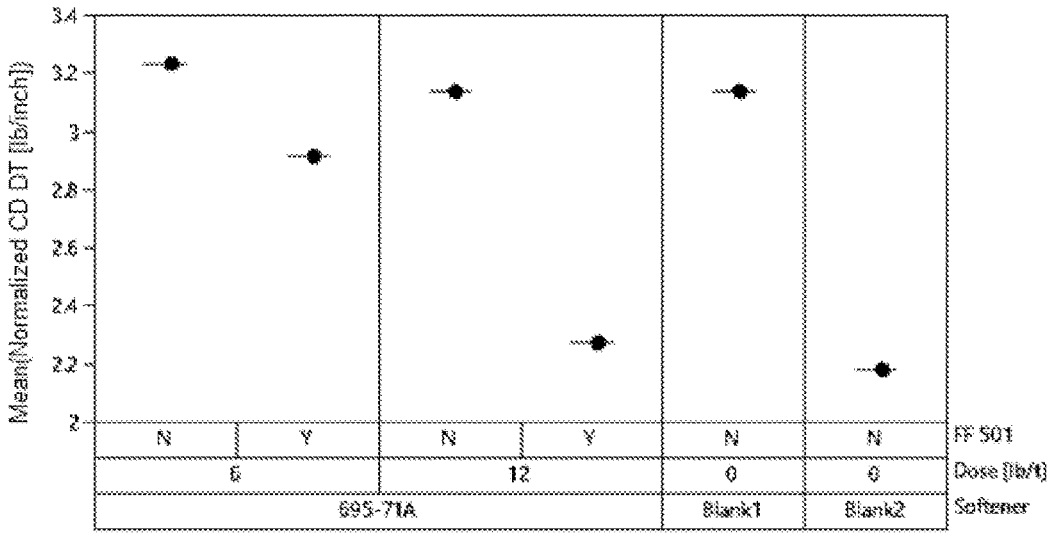
Figure 12:
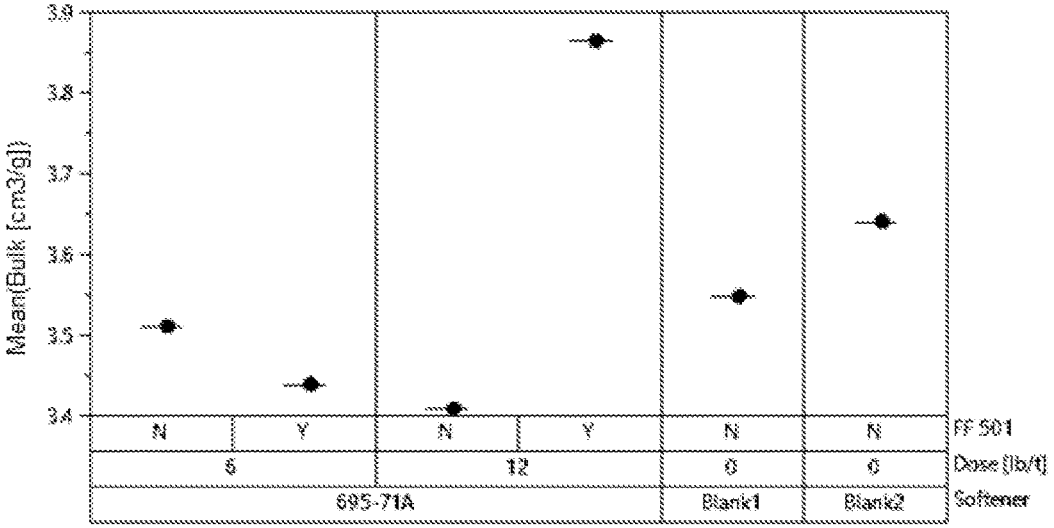
Figure 13:
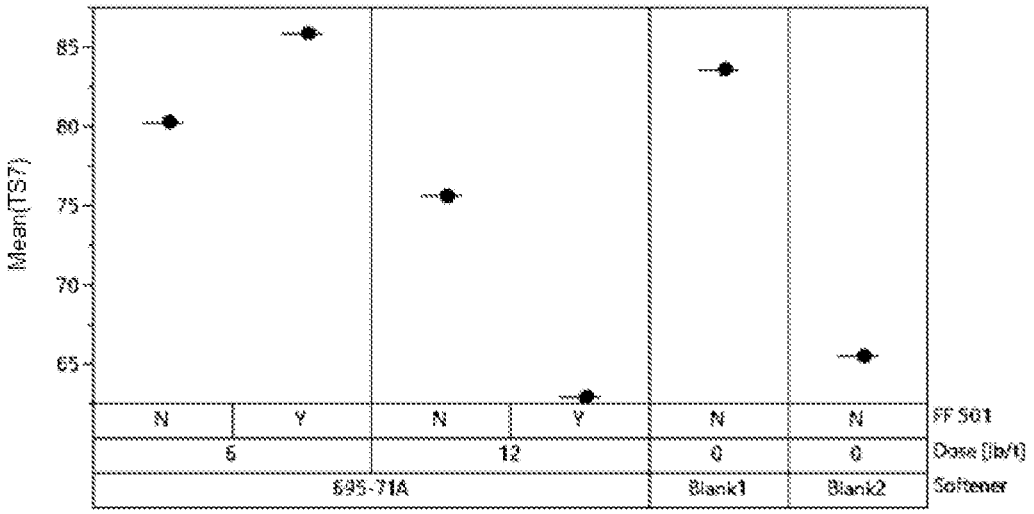
Figure 14:
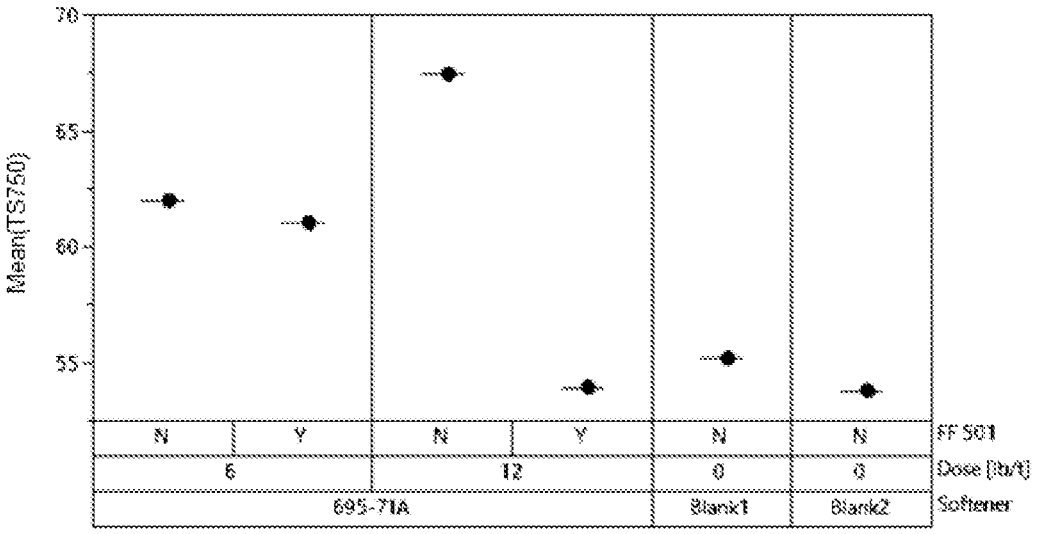
Figure 15:
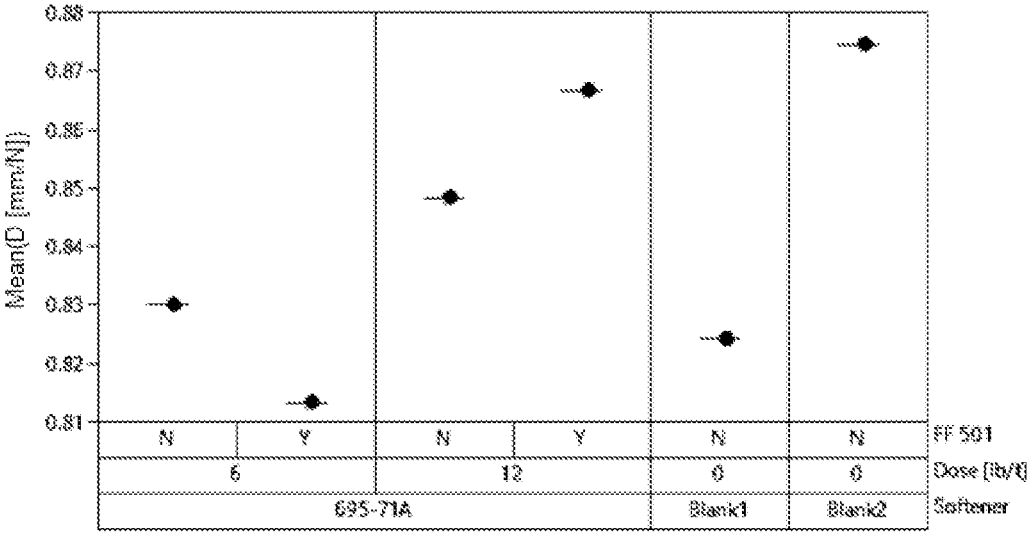

695-71A, the softener emulsion according to the present invention, did not decrease dry tensile when it was used alone (FIG. 11). It is reasonable because most of the components in this formulation is nonionic. When it was used with the commercial coagulant FennoFix 501 (Kemira Oyj), 695-71A showed dry tensile decrease at a dosage of 6 kg/t of dry pulp (12 lb/ton of dry pulp), as weight of the softener concentrate. As of bulking performance (FIG. 12), the results were not very consistent. The only bulk increase was produced by 695-71A at a dosage of 6 kg/t of dry pulp (12 lb/ton of dry pulp), as weight of the softener concentrate, with FennoFix 501 at a dosage of 3 kg/t of dry pulp (6 lb/ton of dry pulp), as solids concentration. This condition gave higher bulk value than blank 2 (i.e., 70:30 eucalyptus to softwood). FIGS. 13 to 15 show the TSA results. When used without coagulant, 695-71A did not decrease TS7. When used with FennoFix 501, 695-71A at a dosage of 6 kg/t of dry pulp (12 lb/ton of dry pulp), as weight of the softener concentrate, showed a slight decrease in TS7 and increase in D value. FennoFix 501 is likely to help retain the softener onto fibers, which led to the increase of D value (another indication of better softness).

TABLE 6

Dosage, dry tensile, bulk, and softness values for Example 4.

| Softener | Dosage, kg/t (lb/ton) | FF 501 | Normalized CD DT, kN/m (lb/in) | Bulk $cm^3/g$ | TS7, dB | TS 750, dB | D, mm/N |
|---|---|---|---|---|---|---|---|
| 695-71A | 3 (6) | N | 0.565 (3.23) | 3.51 | 80.245 | 61.980 | 0.83 |
| 695-71A | 3 (6) | Y | 0.509 (2.91) | 3.44 | 85.851 | 61.021 | 0.81 |
| 695-71A | 6 (12) | N | 0.550 (3.14) | 3.41 | 75.577 | 67.450 | 0.85 |
| 695-71A | 6 (12) | Y | 0.397 (2.27) | 3.86 | 62.903 | 53.920 | 0.87 |
| Blank 1 | 0 | N | 0.550 (3.14) | 3.55 | 83.562 | 55.163 | 0.82 |
| Blank 2 | 0 | N | 0.382 (2.18) | 3.64 | 65.469 | 53.773 | 0.87 |

Example 5. Viscosity Reduction by Hand Homogenizer

An emulsion with 30% softener concentrate content was prepared according to the procedure shown in Example 1. This softener emulsion was treated by several passes through a high-shear homogenizer until the viscosity reached approximately 100 cPs. Table 7 presents the change in viscosity after the treatment with the hand homogenizer. It can be clearly seen that high shear force can reduce the viscosity significantly. The results of particle size analysis are displayed in Table 8. Particle size was reduced as well after the treatment. In addition, the emulsion after treatment exhibited a lower standard deviation of particle size, indicating a narrower particle size distribution.

TABLE 7

Viscosity reduction of softener emulsion treated by the hand homogenizer.

| Pass of the treatment by hand homogenizer | Viscosity of 695-71A, cPs |
|---|---|
| As is | 3288 |
| $1^{st}$ pass | 896 |
| $2^{nd}$ pass | 316 |
| $3^{rd}$ pass | 200 |
| $4^{th}$ pass | 112 |

TABLE 8

Particle size analysis of the emulsion according to the present invention treated by the hand homogenizer.

| | 695-71A, as is | 695-71A, 4 passes |
|---|---|---|
| Particle size - Median, μm | 1.714 | 0.987 |
| Particle size - Mean, μm | 2.813 | 1.212 |
| Particle size - Standard Deviation, μm | 3.293 | 0.781 |

The phenomenon of cavitation during the homogenization involves in the release of entrained air. In these softener emulsions, oxidizing or reducing agents do not exist. Therefore, the ORP value of the emulsion is solely contributed by the oxygen in the entrained or dissolved air. It suggests that the ORP value of the emulsion can indicate the effectiveness of the removal of the entrained air by the hand homogenizer. Table 9 presents the results of the ORP values and the corresponding viscosities of 695-71A during the treatment by the hand homogenizer. The results show that both ORP value and viscosity decreased after the post treatment by homogenizer.

TABLE 9

Viscosity and ORP results after the softener emulsion treated by hand homogenizer.

| Pass of the treatment by hand homogenizer | Viscosity of 695-71A, cPs | ORP of 695-71A, mV |
|---|---|---|
| As is | 696 | 206 |
| $1^{st}$ pass | 456 | 189 |
| $3^{rd}$ pass | 204 | 141 |

Example 6. Viscosity Reduction by Ultrasonic Treatment

Figure 16:
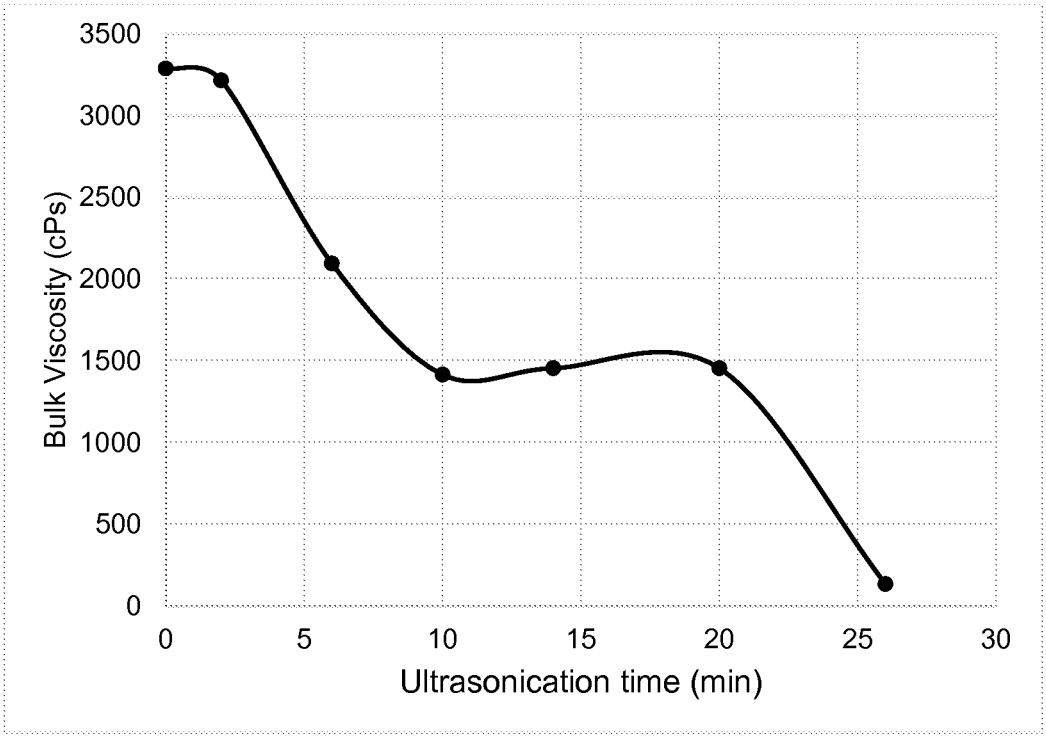

During the ultrasonic treatment, air bubbles were observed on the surface of the softener emulsion. FIG. 16 illustrates the change of the emulsion viscosity during the ultrasonic treatment. The starting viscosity was higher than 3000 cPs. With increasing the treatment time, the viscosity of emulsion decreased. After 26 minutes, the viscosity reached 136 cPs. Table 10 shows the results of the particle size analysis. Compared to the untreated emulsion, ultrasonic treatment gave smaller mean and median values of particle size.

TABLE 10

Particle size analysis of softener emulsions treated by ultrasound.

| | 695-71A, as is | 695-71A, 26 min |
|---|---|---|
| Particle size - Median, μm | 1.714 | 1.530 |
| Particle size - Mean, μm | 2.813 | 2.553 |
| Particle size - Standard Deviation, μm | 3.293 | 3.541 |

The invention claimed is:

1. A softener concentrate to be emulsified with water to form an oil-in-water softener emulsion for use in manufacture of a paper, tissue or paperboard, comprising:

5 to 10 wt % of an imidazoline-based surfactant with a carbon chain of 16 to 18 carbon atoms based on the total weight of the softener concentrate;

5 to 10 wt % of a lanolin-based softener based on the total weight of the softener concentrate;

5 to 20 wt % of phospholipids based on the total weight of the softener concentrate; and 60 to 85 wt % of a surfactant blend based on the total weight of the softener concentrate comprising polysorbate ester, sorbitan ester-based surfactants, polypropylene glycol, polyethylene glycol, and their esters, silicon-based softeners, or any combination thereof.

2. The softener concentrate according to claim 1, wherein the concentrate comprises 5 wt % imidazoline-based surfactant, 5 wt % lanolin-based softener, 10 wt % phospholipids, and 80 wt % surfactant blend, of the total weight of the softener concentrate.

3. The softener concentrate according to claim 1, wherein the lanolin-based softener comprises USP grade lanolin.

4. The softener concentrate according to claim 1, wherein the phospholipids comprise lecithin.

5. The softener concentrate according to claim 1, wherein the softener concentrate is substantially free of water.

6. A softener emulsion for use in manufacture of paper, tissue or paperboard comprising:

20 to 50 wt-% of the softener concentrate according to claim 1, and 50 to 80 wt-% of water, of the total weight of the softener emulsion.

7. A process for making paper, tissue or paperboard, wherein a softener emulsion according to claim 6 is added to fiber slurry having a consistency of 0.05 wt. % to 8 wt. % at the wet end of a paper machine, and/or a softener emulsion according to claim 6 is applied on a wet fiber web having a moisture level of 30 to 90% as weight percentage of water in the wet fiber web, and/or a softener emulsion according to claim 6 is applied on a dry sheet of paper or a converted roll of paper having a moisture level of less than 12%, as weight percentage of water in the dry sheet of paper or the converted roll.

8. The softener emulsion according to claim 6, wherein the softener emulsion further comprises an electrolyte selected from soluble salts, acids, bases, polyelectrolytes, and any combination thereof.

9. The softener emulsion according to claim 6, wherein the softener emulsion comprises an electrolyte in an amount of 0.01 to 1.0 wt-% of the weight of the softener emulsion, and wherein the softener emulsion has a viscosity lower than 500 cPs measured with a Brookfield Viscometer, DV2T, with #63 spindle and spindle rotation speed at 30 rpm at ambient temperature.

10. A process for producing a softener emulsion, the process comprising:

providing a softener concentrate according to claim 1, emulsifying the softener concentrate with water, thus forming a softener emulsion comprising 20 to 50 wt-% softener concentrate of the total weight of the softener emulsion, and treating the softener emulsion with a high shear homogenizer and/or ultrasonic energy, thus reducing viscosity of the softener emulsion.

11. The process according to claim 10, wherein the process further comprises adding an electrolyte selected from soluble salts, acids, bases, polyelectrolytes, and any combination thereof.

12. The process according to claim 11, wherein the electrolyte is added before, during and/or after the emulsifying step, and/or the electrolyte is added before, during and/or after the high shear homogenizer and/or the ultrasonic energy treatment.

13. The process according to claim 11, wherein the electrolyte is added in an amount of 0.01-1.0 wt. % of the weight of the softener emulsion.

14. The process according to claim 10, wherein the softener emulsion is treated with the ultrasonic energy treatment for a period of 1 to 60 min.

* * * * *